United States Patent [19]

Foreman et al.

[11] Patent Number: 4,770,134

[45] Date of Patent: Sep. 13, 1988

[54] ENGINE PREHEATER

[75] Inventors: Joseph F. Foreman, Hannibal; John S. Rhoads, New London, both of Mo.

[73] Assignee: Watlow Industries, Inc., Hannibal, Mo.

[21] Appl. No.: 926,734

[22] Filed: Nov. 4, 1986

[51] Int. Cl.[4] ..... F02N 17/02; H05B 1/02

[52] U.S. Cl. ..... 123/142.5 R; 219/202; 237/12.3 R

[58] Field of Search ..... 237/12.3 B, 12.3 R; 126/350 A; 219/202, 208, 279, 204; 123/142.5 E, 142.5 R

[56] References Cited

U.S. PATENT DOCUMENTS

| | | | |
|---|---|---|---|
| 2,266,216 | 12/1941 | Kimberlin | 219/38 |
| 3,626,148 | 12/1971 | Woytowich | 219/208 |
| 4,208,570 | 6/1980 | Rynard | 219/208 |
| 4,245,593 | 1/1981 | Stein | 123/142.5 R |
| 4,249,491 | 2/1981 | Stein | 123/142.5 R |
| 4,591,691 | 5/1986 | Badali | 237/12.3 B X |

OTHER PUBLICATIONS

Kim Hotstart Mfg. Co., Inc., Bulletin CH-100 for Engine Pre-Heaters and Accessories; (pp. 3-10 and Front and Rear Covers).

*Primary Examiner*—Henry A. Bennett

*Attorney, Agent, or Firm*—Senniger, Powers, Leavitt and Roedel

[57] ABSTRACT

An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank. The preheater includes an electric heating element in the tank spaced from the inlet of the tank for heating engine coolant in the tank and a temperature sensor inside the tank adjacent the inlet of the tank. The sensor is so positioned relative to the inlet and the heating element that it is adapted accurately to sense the temperature of engine coolant flowing into the tank via the inlet before the incoming engine coolant is substantially heated by the heating element.

21 Claims, 1 Drawing Sheet

ENGINE PREHEATER

BACKGROUND OF THE INVENTION

This invention relates generally to engine preheaters, and more particularly to an improved engine preheater for heating engine coolant to warm the engine when it is not running.

That engines are difficult to start and subject to excessive wear when operated in cold, northern areas has been common knowledge for many years. Various kinds of engine preheaters that heat engine coolant and/or engine oil have been used to ameliorate these problems. Heretofore, while preheaters have heated engine coolant while the engine is off thereby increasing the reliability and lifespan of the engine, the preheaters have not always been reliable. Problems have included thermostat "burn-out" due to excessive cycling of the thermostat and "dry fires" in the preheater due to no-flow or low-flow conditions when a coolant hose is either partly or completely clogged or pinched shut, or when the flow of coolent is reversed by operation of the engine, thereby closing preheater valve(s) and stopping flow.

The thermostat may be "burned-out" by its excessive cycling (thermostat "chatter"), which is sometimes caused by placing the temperature sensor for the thermostat too close to the heating element controlled by the thermostat, in which case the sensor detects rapid changes in temperature after the heating element starts to heat up or cool down. The farther the temperature sensor is from the heating element, therefore, the less frequently the thermostat is likely to cycle.

"Dry fires", on the other hand, are caused by the preheater being low or short of coolant because of low coolant level in the coolant system, or no-flow conditions due to preheater valve(s) closed by back flow through the preheater during engine operation. "Dry fires" may be prevented by placing the temperature sensor and the heating element close to one another in locations where nothing is likely to interfere with the sensor's detection of excessive heat. If the sensor and heating element are close to each other, dry fires are prevented by the ability of the sensor to detect the increased temperature so that the thermostat may turn the heating element off.

Another approach to preventing "dry fires", at least when caused by backflow while the engine is running, has been to provide a pressure switch to deactivate the preheater when the engine is running. However, the addition of a pressure switch increases the cost and complexity of the preheater.

Typically, preheaters are designed to prevent thermostat "burn-out" by placing the thermostat and temperature sensor outside of the preheater along the coolant line carrying coolant to be heated. This approach successfully reduces the problem of excessive cycling of the thermostat while ignoring the problem of dry fires in the preheater. In addition, wiring associated with a sensor and thermostat placed separately along the coolant line may become entangled with other wires and hoses, thereby making installation of the preheater difficult and complicated.

SUMMARY OF THE INVENTION

Among the several objects of the invention may be noted the provision of an engine preheater for an internal combustion engine or the like that heats and provides for circulation of engine coolant to keep the engine warm, especially during cold weather; the provision of such an engine preheater which is resistent to "dry fire" and other failures; the provision of such an engine preheater which does not cycle excessively ("chatter") between heating and inactive modes; the provision of such an engine preheater which comprises a minimum number of parts and which has a generally uncomplicated design; the provision of such a preheater for which a pressure switch is unnecessary; the provision of such an engine preheater which may be installed easily on an engine; and the provision of such an engine preheater which is durable and reliable.

Generally, an engine preheater of the present invention comprises a tubular tank adapted to be mounted generally horizontally and having an inlet adjacent one end of the tank for flow of engine coolant into the tank and an outlet adjacent the opposite end of the tank for flow of heated engine coolant out of the tank. The preheater includes an electric heating element in the tank spaced from the inlet of the tank for heating engine coolant in the tank and temperature sensing means inside the tank. The temperature sensing means includes a temperature sensor adjacent the inlet of the tank. The sensor is so positioned relative to the inlet and the heating element that it is adapted accurately to sense the temperature of engine coolant flowing into the tank via the inlet before the incoming engine coolant is substantially heated by the heating element. The heating element is responsive to the temperature of incoming coolant as sensed by the temperature sensor.

In a second aspect of this invention, an engine preheater comprises a tubular tank adapted to be mounted generally horizontally and having an inlet adjacent one end of the tank for flow of engine coolant into the tank and an outlet adjacent the opposite end of the tank for flow of heated engine coolant out of the tank. The engine preheater includes an electric heating element in the tank spaced from the inlet of the tank for heating engine coolant in the tank and temperature sensing means inside the tank. The temperature sensing means comprises a temperature sensor adjacent the inlet of the tank. The engine preheater also includes a thermostat for controlling the operation of the heating element in response to the temperature of the engine coolant entering the tank as sensed by the temperature sensor and a housing at one end of the tank for housing the thermostat and wiring for the heating element and temperature sensor.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
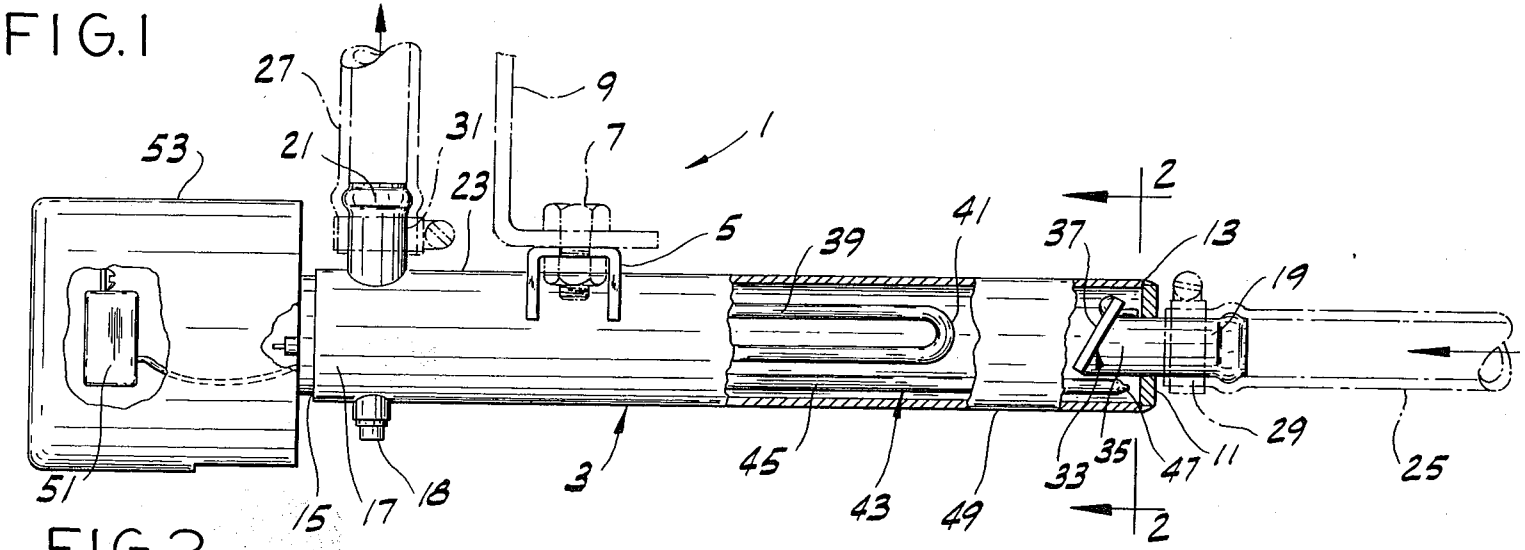
FIG. 1 is a side elevation of an engine preheater of the present invention with portions broken away to illustrate details.

Now referring to the drawings, an engine preheater of the present invention is designated in its entirety by the reference numeral 1. The preheater is adapted to be attached to an engine (not shown) and connected to the engine's coolant system to heat the coolant and thereby keep the engine warm when the engine is not in operation.

As shown in FIG. 1, the engine preheater 1 comprises a tubular tank generally designated 3 adapted to be mounted generally horizontally. For example, means for mounting the tank 3 in a generally horizontal position includes a bracket 5 which may be bolted (by bolts 7) to an engine bracket 9 (shown in phantom). End wall 11 closes one (inlet) end 13 of the tank 3, and end wall 15 closes the opposite (outlet) end 17. A drain plug 18 is provided at the bottom of the tank 3.

An inlet (tube) 19 is provided adjacent the inlet end 13 of the tank 3 for flow of engine coolant into the tank and an outlet (tube) 21 adjacent the outlet end 17 of the tank for flow of heated engine coolant out of the tank. The inlet tube 19 preferably extends through the end wall 11 at the inlet end 13 of the tank, and the outlet tube 21 extends upwardly from the top 23 of the tank adjacent the end wall 15. As shown in phantom, inlet and outlet hoses 25 and 27, respectively, may be attached to the inlet and outlet tubes 19 and 21, respectively, of the tank (e.g., by hose clamps 29 and 31, respectively).

Throughout the description and drawings, "downstream" refers to the direction of the outlet tube 21 from the inlet tube 19 (i.e., generally left in FIG. 1). "Back-flow" refers to flow in the upstream direction (i.e., generally right in FIG. 1).

Figure 2:
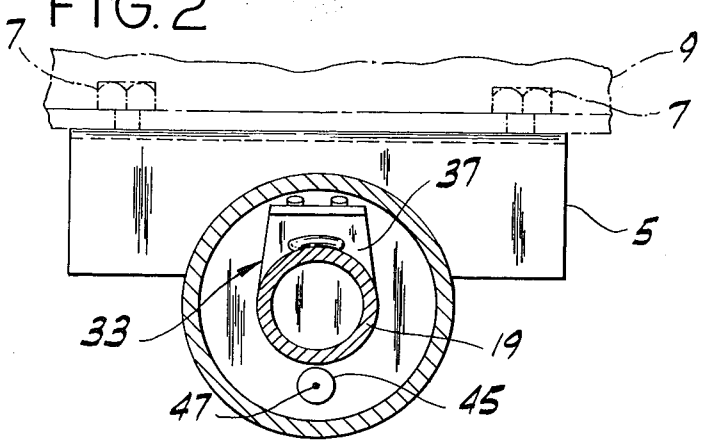
FIG. 2 is a cross-sectional view taken along line 2—2 of FIG. 1 showing details of an inlet for the engine preheater of FIG. 1.

As shown in FIGS. 1 and 2, a one-way check valve generally designated 33 is mounted at the downstream end 35 of the inlet tube 19. The check valve 33 permits flow through the inlet 19 into the tank 3 but prevents back-flow through the inlet. Check valve 33 includes a pivotable valve plate 37 which is designed to pivot (generally upwardly) between a closed position (shown in FIG. 1) wherein it closes the downstream end 35 of the inlet tube 19 to an open position (not shown) wherein coolant may flow into the tank. The downstream end 35 of the inlet tube 19 is preferably slanted from vertical (for example, at an angle of approximately 30 degrees off vertical) so that the valve plate 37 is gravity-baised toward its closed position.

The engine preheater 1 includes an electric heating element 39 in the tank 3 extending from the outlet end 17 of the tank to a point 41 spaced (e.g., a minimum of 3 in. (76 mm)) from the inlet 19 of the tank for heating engine coolant in the tank. FIG. 1 shows the heating element 39 as having a generally U-shape, but it is to be understood that the heating element may have a variety of different configurations.

Preferably, temperature sensing means 43 is provided inside the tank 3. Such sensing means includes a tubular member 45 (e.g., a thermowell having a 0.315 in. (8 mm) internal diameter) extending generally longitudinally of the tank 3 from the outlet end 17, and a temperature sensor 47 mounted in the tubular member adjacent one end thereof, the sensor being positioned adjacent the inlet 19 of the tank. The temperature sensor 47 may be of the bulb and capillary type and of copper material. The temperature sensor 47 is so positioned relative to the inlet 19 and to the heating element 39 that it is adapted accurately to sense the temperature of engine coolant flowing into the tank via the inlet before the incoming engine coolant is substantially heated by the heating element. As illustrated in the drawings, for example, the temperature sensor 47 is positioned at a level below that of the inlet tube 19 on the underside of the inlet tube between the inlet tube and the bottom 49 of the tank.

The temperature sensor 47 and the heating element 39 are spaced a substantial distance apart so that heat from the heating element does not excessively influence or mislead the temperature sensor (e.g., a minimum of 3 in. (76 mm) in a tank 3 having an 18–20 in. (460–510 mm) length and a 2 in. (51 mm) internal diameter).

A conventional thermostat 51 is provided for controlling the operation of the heating element 39 in response to the temperature of the engine coolant entering the tank 3 as sensed by the temperature sensor 47. The thermostat 51 activates the heating element 39 when the temperature sensor 47 detects a relatively low temperature (e.g., 90°–100° F. (33°–39° C.)) of engine coolant and deactivates the heating element when the temperature sensor detects a relatively high temperature (e.g., 20° F. (11° C.) higher than the low temperature or 110°–120° F. (45°–50° C.)) of engine coolant. Preferably, a housing 53 is provided at the outlet end 17 of the tank for housing the thermostat 51 and wiring (not shown) for the heating element 39 and temperature sensor 47.

It will be observed that the engine preheater 1 may be installed and removed easily from the engine (not shown) since the wiring for the thermostat 51, heating element 39 and temperature sensor 47 is located within a single housing 53.

For some applications, a pressure switch (not shown) is provided for turning the preheater off when the engine is running. The pressure switch cuts off power to the preheater 1 when the engine coolant pressure rises above a predetermined pressure (e.g., 5–10 psig (34–69 kPa gage)), as it does when the engine is running.

A pressure switch has been necessary for prior preheaters, because coolant backflow toward the preheater caused by the engine closes the valve(s), stopping coolant flow and thereby allowing overheating ("dry fire"). It will be observed that a pressure switch is unnecessary for preheater 1 since the temperature sensor 47 is positioned within the preheater where it will deactivate the heating element 39 before overheating occurs. However, it will also be observed that the addition of a pressure switch (for those who are concerned about its absence) does not detract from the performance of the preheater 1.

In operation (e.g., when the engine is not operating), when the temperature sensor 47 detects engine coolant at low temperature, the thermostat activates the heating element 39 to heat the coolant entering the tank 3 via inlet tube 19. The coolant system functions as a thermosiphon wherein the differences in density of the coolant cause "natural" circulation of the coolant. The pressure of the coolant increases and the density decreases as the coolant is heated, causing coolant to flow upwardly through the outlet tube 21 into the outlet hose 27. As the heated coolant flows upwardly through the outlet 21, coolant to be heated flows from the inlet hose 25 through the inlet tube 19 into the tank 3. Back-flow into the inlet hose 25 is prevented by the one-way check valve 33.

In the event that the inlet tube 25 becomes clogged or valve 33 is closed by backflow from the engine, the temperature sensor 47 will detect increasing temperature within the tank 3 since no incoming fluid would be entering the tank, and then the thermostat 51 will deactivate the heating element 39 before the coolant becomes overheated. It will, therefore, be observed that "burn-out" of the heating element 39 and "dry fire" in the engine preheater are prevented by the relative positions of the inlet valve 33, temperature sensor 47 and the heating element.

It will be also observed that, since the heating element 39 and temperature sensor 47 are separated by a substantial distance (e.g., a minimum of 3 in. (76 mm)), the thermostat will not cycle constantly ("chatter") as it would if the heating element and sensor were adjacent one another. Therefore, premature failure or "burn-out" of the thermostat 51 is prevented.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank, and electric heating element in the tank spaced from the inlet of the tank for heating engine coolant in the tank, and temperature sensing means inside the tank comprising a temperature sensor adjacent the inlet of the tank, said sensor being so positioned relative to the inlet and the heating element that it is adapted accurately to sense the temperature of engine coolant flowing into the tank via said inlet before the incoming engine coolant is substantially heated by said heating element, said heating element being responsive to the temperature of incoming coolant as sensed by the temperature sensor.

2. An engine preheater as set forth in claim 1 further comprising a one-way check valve permitting flow through the inlet into the tank but preventing back-flow through the inlet.

3. An engine preheater as set forth in claim 1 wherein said tank has end walls closing the inlet and outlet ends of the tank, said sensor being disposed generally between the heating element and the inlet end of the tank adjacent said inlet.

4. An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank, an electric heating element in the tank spaced from the inlet of the tank for heating engine coolant in the tank, and temperature sensing means inside the tank comprising a temperature sensor adjacent the inlet of the tank, said sensor being so positioned relative to the inlet and the heating element that it is adapted accurately to sense the temperature of engine coolant flowing into the tank via said inlet before the incoming engine coolant is substantially heated by said heating element, said heating element being responsive to the temperature of incoming coolant as sensed by the temperature sensor, the preheater further comprising a one-way check valve permitting flow through the inlet into the tank but preventing back-flow through the inlet, said tank having end walls closing the inlet and outlet ends of the tank, said inlet comprising an inlet tube extending through the end wall at the inlet end of the tank, said check valve being mounted at the downstream end of the inlet tube, said temperature sensor being positioned at a level below that of the inlet tube.

5. An engine preheater as set forth in claim 4 wherein said temperature sensor is positioned on the underside of said inlet tube between the inlet tube and the bottom of the tank.

6. An engine preheater as set forth in claim 1 further comprising a thermostat for controlling the operation of the heating element in response to the temperature of the engine coolant entering the tank as sensed by the temperature sensor.

7. An engine preheater as set forth in claim 6 further comprising a housing adjacent the tank for housing said thermostat and wiring for said heating element and temperature sensor.

8. An engine preheater as set forth in claim 7 wherein said housing is at the outlet end of the tank on the outside of the tank.

9. An engine preheater as set forth in claim 8 wherein said temperature sensing means further comprises a tubular member extending generally longitudinally of the tank from the housing, said temperature sensor being mounted in the tubular member adjacent one end thereof.

10. An engine preheater as set forth in claim 1 further comprising means for mounting the tank in a generally horizontal position.

11. An engine preheater as set forth in claim 1 wherein said electric heating element extends from the outlet end of the tank to a point spaced from the inlet of the tank.

12. An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank, an electric heating element in the tank spaced from the inlet of the tank for heating engine coolant in the tank, temperature sensing means inside the tank comprising a temperature sensor adjacent the inlet of the tank, a thermostat for controlling the operation of the heating element in response to the temperature of the engine coolant entering the tank as sensed by the temperature sensor, and a housing adjacent the tank for housing said thermostat and wiring for said heating element and temperature sensor.

13. An engine preheater as set forth in claim 12 wherein said temperature sensor is so positioned relative to the inlet and to the heating element that it is adapted accurately to sense the temperature of engine coolant flowing into the tank via said inlet before the incoming engine coolant is substantially heated by said heating element.

14. An engine preheater as set forth in claim 13 wherein said temperature sensor is positioned at a level below that of the inlet.

15. An engine preheater as set forth in claim 14 wherein said tank has end walls closing the inlet and outlet ends of the tank, said sensor being disposed generally between the heating element and the inlet end of the tank adjacent said inlet.

16. An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank, an electric heating element in the tank spaced from the inlet of the tank for heating engine coolant in the tank, temperature sensing means inside the tank comprising a temperature sensor adjacent the inlet of the tank, a thermostat for controlling the operation of the heating element in response to the temperature of the engine coolant entering the tank as sensed by the temperature sensor, and a housing adjacent the tank for housing said thermostat and wiring for said heating element and temperature sensor, said temperature sensor being so positioned relative to the inlet and to the heating element that it is adapted accurately to sense the temperature of engine coolant flowing into the tank via said inlet before the incoming engine coolant is substantially heated by said heating element, said temperature sensor being positioned at a level below that of the inlet, said tank having end walls closing the inlet and outlet ends of the tank, said inlet comprising an inlet tube extending through the end wall at the inlet end of the tank, said temperature sensor being positioned on the underside of said inlet tube between the inlet tube and the bottom of the tank.

17. An engine preheater as set forth in claim 12 further comprising a one-way check valve permitting flow through the inlet into the tank but preventing back-flow through the inlet.

18. An engine preheater as set forth in claim 12 wherein said housing is at the outlet end of the tank on the outside of the tank.

19. An engine preheater as set forth in claim 18 wherein said temperature sensing means further comprises a tubular member extending generally longitudinally of the tank from the housing, said temperature sensor being mounted in the tubular member adjacent one end thereof.

20. An engine preheater as set forth in claim 12 further comprising means for mounting the tank in a generally horizontal position.

21. An engine preheater as set forth in claim 20 wherein said electric heating element extends from the outlet end of the tank to a point spaced from the inlet of the tank.

* * * * *